US005738807A

United States Patent [19]

Moon

[11] Patent Number: 5,738,807

[45] Date of Patent: Apr. 14, 1998

[54] AIR BUBBLE GENERATING APPARATUS

[75] Inventor: Sung-Dai Moon, Kyeongsangbuk-Do, Rep. of Korea

[73] Assignee: Daewoo Electronics Co. Ltd, Seoul, Rep. of Korea

[21] Appl. No.: 710,940

[22] Filed: Sep. 24, 1996

[51] Int. Cl.[6] ..... B01F 3/04

[52] U.S. Cl. ..... 261/28; 261/87; 261/DIG. 75; 261/64.4; 415/216

[58] Field of Search ..... 261/87, DIG. 75, 261/28, 64.4; 415/216

[56] References Cited

U.S. PATENT DOCUMENTS

| | | | |
|---|---|---|---|
| 1,893,776 | 1/1933 | Hall | 137/533.11 |
| 2,516,328 | 7/1950 | Lowry | 137/533.11 |
| 2,961,847 | 11/1960 | Whitney, Jr. et al. | 415/116 |
| 3,132,839 | 5/1964 | Haekal | 261/87 |
| 3,213,798 | 10/1965 | Carswell | 415/116 |
| 3,237,565 | 3/1966 | Hartland | 415/116 |
| 3,305,215 | 2/1967 | Swiecicki et al. | 261/87 |
| 3,462,132 | 8/1969 | Kaelin | 261/87 |
| 3,896,027 | 7/1975 | Digney et al. . | |
| 4,018,859 | 4/1977 | Muller | 261/87 |
| 4,290,979 | 9/1981 | Sugiura | 261/4 |
| 4,985,181 | 1/1991 | Strada et al. | 261/87 |
| 5,591,001 | 1/1997 | Ray et al. | 415/116 |

FOREIGN PATENT DOCUMENTS

| | | |
|---|---|---|
| 0 021470 A1 | 1/1981 | European Pat. Off. . |
| 0 042 620 A1 | 12/1981 | European Pat. Off. . |
| 2513541 | 4/1983 | France . |
| 3308035 A1 | 9/1994 | Germany . |
| 2047343 | 12/1980 | United Kingdom . |

*Primary Examiner*—Tim R. Miles

[57] ABSTRACT

An air bubble generating apparatus has an air supplying device integrated with a pump. The air bubble generating apparatus comprises a pump for pumping water and for receiving a vacuum at a center portion thereof during pumping the water, a driving source for driving the pump, and an air supplying device for supplying air for the water by using an air pressure difference between the center portion in the vacuum state and an atmosphere. The air supplying device includes a hollow shaft through which the air flows, a first valve assembly adjacent to a first end of the hollow shaft and screwed in a bearing holder of the driving source, and a second valve assembly arranged at a second end of the hollow shaft. When the pump is operated so that a vacuum pressure is generated in the pump, the solenoid valve opens, so that there is a difference in pressure between the pump and the air supplying device. The ball valve of the air supplying device is opened by the difference in the pressure between the pump and the air supplying device, so that air is introduced into the pump and air bubbles are generated in pumped water.

27 Claims, 3 Drawing Sheets

AIR BUBBLE GENERATING APPARATUS

BACKGROUND OF THE INVENTION

1. Field of the Invention

The present invention relates to an air bubble generating apparatus, and more particularly to an air bubble generating apparatus that is integrated with a water pump, has a simple structure, provides circulating water with air in an aquarium, a fish bowl used at home, or a waste water treatment system.

2. Description of the Prior Art

In general, an air bubble generating apparatus is used for increasing a quantity of dissolved oxygen in a water of an aquarium or a fish bowl used at home. Furthermore, recently, an air bubble generating apparatus has been applied to a washing machine in which during a washing of laundry, it is used to increase a washing power. The air bubble generating apparatus is applied to the aquarium, the fish bowl used at home, or the washing machine, etc. Additionally, a water pump is applied to the aquarium, the fish bowl used at home, or the washing machine, etc., so as to circulate a water thereof. Also, the air bubble generating apparatus may be used to provide air to a waste water in a waste water treatment system so that organic substances contained in the waste water are oxidized by the air.

FIG. 1A and FIG. 1B. respectively are a cross sectional view and a schematic perspective view of an air bubble generating apparatus according to a prior art. In FIGS. 1A and 1B, the air bubble generating apparatus includes an air pump (not shown) and an air bubble generator 10. In a case of using the air bubble generating apparatus for some specific use, the air bubble generating apparatus further comprises a control device (not shown). The air bubble generating apparatus comprises a casing 16 having an inlet port 12 connected to the air pump and an outlet port 14 arranged in a position opposite to the inlet port 12. A porous member 18, e.g. made of sponge, is inserted within casing 16. The porous member 18 provides an interface where a pressurized air from the air pump meets a washing fluid. The pressurized air is broken to a plethora of fine bubbles as it passes through the porous member 18. A bubble orientation plate 22 having a number of through holes 20 is rigidly attached to the outlet port 14 in such a manner that the air bubbles created in the bubble generator can be sprayed around the bubble generator 10.

An elastic flap 24 of sufficient flexibility is secured to the upper margin of the bubble orientation plate 22. The elastic flap 24 normally assumes a first position, shown by a phantom line in FIG. 1A, to close off the through holes 20 of the bubble orientation plate 22. When the bubble generator 10 begins to operate, the elastic flap 24 flexes to a second position shown in a solid line in FIG. 1A, allowing the air bubbles to be emitted from the bubble generator 10. Thus, the elastic flap 24 prevents any foreign material from entering the air bubble generating apparatus.

The air bubble generating apparatus according to the prior art needs an air compressor and the air bubble generator so as to generate air bubbles. Also, there is a problem in that the air bubble generating apparatus comprises a separate pump for circulating the water in a washing tub of a washing machine or an aquarium in which the air bubble generator is used. As described above, in the prior art, the pump circulating the water and the air bubble generating apparatus generating the air bubbles are separately installed in the aquarium or the washing machine so that the volume of the pump and the air bubble generating apparatus together is increased and a larger space is needed to mount the pump and the air bubble generating apparatus.

U.S. Pat. No. 4,290,979 (issued to Eiichi Sugiura on Sep. 22, 1981) discloses an aeration apparatus that produces minute air bubbles in an oxygen supply, and a solid particle flotation system that may be used in a waste water treatment system. In Sugiura's patent, the aeration apparatus provides air for liquid in a tank. The aeration apparatus comprises a pump connected to a driving source, a suction pipe for conducting liquid from the tank to the pump, a discharge pipe for returning the liquid from the pump to the tank, an air intake device disposed in the suction pipe and including a body having an air passage that provides a communication between the interior of the suction pipe and the atmosphere, having a valve disposed in the air passage, and having a conduit connecting the discharge pipe and the valve. An injector is connected to an outlet end of the discharge pipe within the tank and includes a housing that defines a doughnut-shaped annular passage, and a means for connecting the annular passage with the outlet end of the discharge pipe with a plurality of injection ports formed around the housing and spaced suitably apart from each other. The size of the air passage is controlled in accordance with the discharge pressure of the pump.

In Sugiura's aeration apparatus, there are problems in that a coupling is provided to transmit power from the driving source to the pump, and in that the air suction device is disposed between the suction pipe and discharge pipe so that the structure of the aeration apparatus is complex.

SUMMARY OF THE INVENTION

The present invention has been made to overcome the above described problem of the prior art. It is an object of the present invention to provide an air bubble generating apparatus that can provide air to circulating water in an aquarium, a fish bowl used at home, or a waste water treatment system. It comprises an air supplying means and a water circulating pump integrally formed so that the air bubble generating apparatus has a simple structure.

To accomplish the above object of the present invention, there is provided an air bubble generating apparatus which comprising:

pump for pumping a water and creating a vacuum state at a center portion thereof during pumping of the water;

a driving source for driving the pump; and means for supplying air for the water by using an air pressure difference between the center portion of the pump in the vacuum state and an atmosphere.

The air supplying means includes a hollow shaft through which the air flows, a first valve assembly adjacent to a first end of the hollow shaft and screwed into a bearing holder of the driving source, and a second valve assembly arranged at a second end of the hollow shaft.

The hollow shaft of the air supplying means includes a rotating shaft of the driving source.

A hollow portion of the hollow shaft of the air supplying means tapers from the first end to the second end, so that the air flow rate reduces when the air flows through the hollow portion.

An air inlet port is formed at the first end of the hollow shaft of the air supplying means.

An air outlet port is formed at the second end of the hollow shaft of the air supplying means, a recess for receiving a ball of valve is formed at the air outlet port, and a frusto-conical valve seat is formed in an inner portion of the air outlet port.

The first valve assembly is preferably a solenoid valve.

The second valve assembly is preferably a ball valve.

The pump includes an impeller and a housing, a cylindrical hub formed at a outer center portion of the impeller, an annular projection is formed at a center portion of the cylindrical hub of the impeller. The second end of the hollow shaft of the air supplying means is inserted into the cylindrical hub, and a water suction portion is formed at the center portion of the housing.

Furthermore, a plurality of through holes are formed around the annular projection at the center portion of the impeller.

When a vacuum pressure is generated in the impeller by a rotation of said impeller during an operation of said pump so that there is a difference in a pressure of the hollow portion and of an inner portion of said impeller, the valve ball of the second valve assembly arranged between the second end of the hollow shaft and the annular projection at the center portion of the impeller can be moved to the projection so that the air flows through the through holes into the impeller.

The driving source includes a cylindrical housing, stators arranged on an inner periphery of the housing at a predetermined distance apart from each other, and a rotor rotatably inserted in a cylindrical space of the housing. The bearing holder is inserted into a first opening of the cylindrical space and a second opening thereof is covered with an end cover.

The end cover comprises a cylindrical bearing holder portion and a flange portion. A first groove is formed along a periphery of the cylindrical bearing holder, and a first annular sealing ring is arranged in the cylindrical bearing holder. A second groove is formed along an edge of the flange portion of the end cover, a second annular sealing ring is inserted in the flange portion, and the housing of the pump is coupled to the edge of the flange portion of the end cover.

A screw is formed in an inner peripheral surface of the bearing holder, a bearing is arranged at a portion opposite to a side portion of the driving source, and the first valve assembly is screwed to the screw at the inner peripheral surface of the bearing holder.

As described above, when the air bubble generating apparatus according to the present invention is mounted in and used in the aquarium or the fish bowl, the air is periodically mixed with the circulating water so that the amount of the oxygen present in the aquarium or the fish bowl is constantly maintained.

On the other hand, when the air bubble generating apparatus is mounted in and used in a washing machine, the washing water mixed with the air bubble is supplied through a fluid passage into the washing tub during a washing so that a washing efficiency of the laundry is enhanced.

Furthermore, the air bubble apparatus according to the present invention is used for providing air to waste water in a waste water treatment system so that organic substrates contained in the waste water is oxidized.

BRIEF DESCRIPTION OF THE DRAWINGS

The above object and other advantages of the present invention will become more apparent by describing in detail the preferred embodiment thereof with reference to the attached drawings, in which.

DESCRIPTION OF THE PREFERRED EMBODIMENT

Hereinafter, a preferred embodiment of the present invention will be described in detail with reference to the accompanying drawings.

Figure 1A:
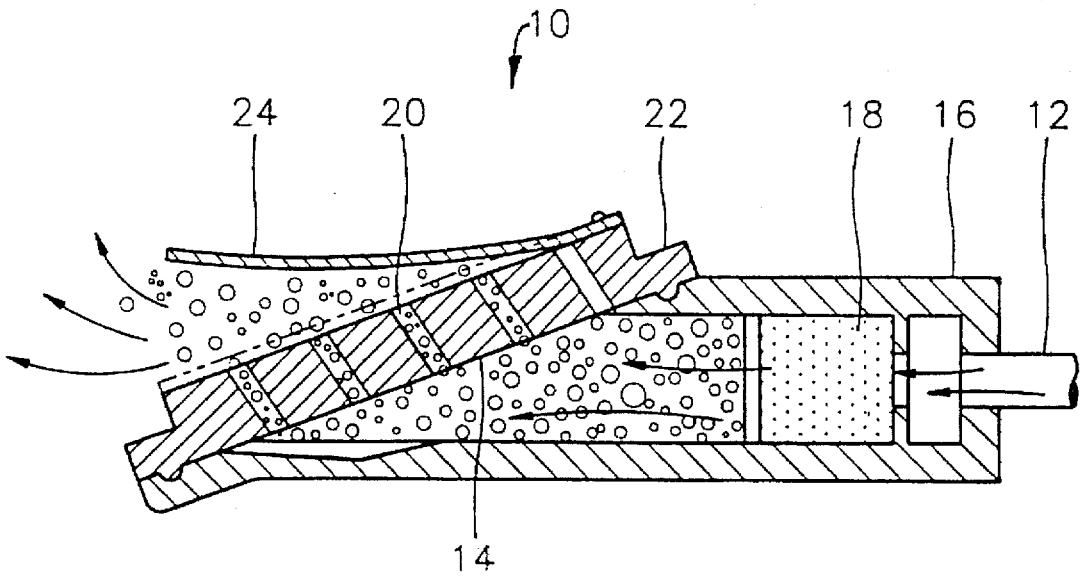
FIG. 1A (PRIOR ART)
FIG. 1A and FIG. 1B respectively are a sectional view and a schematic perspective view of an air bubble generating apparatus according to the conventional art.
Figure 1B:
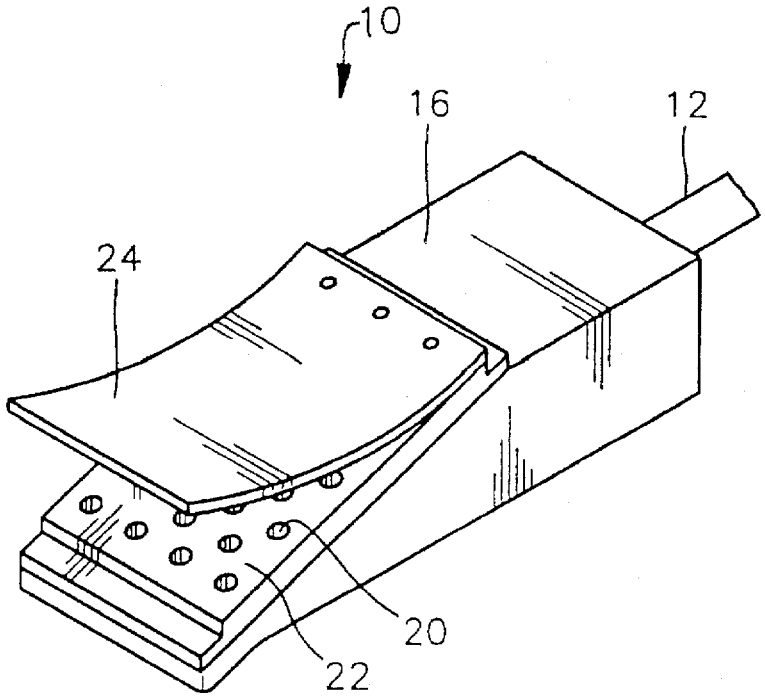
FIG. 1B (PRIOR ART)
Figure 2:
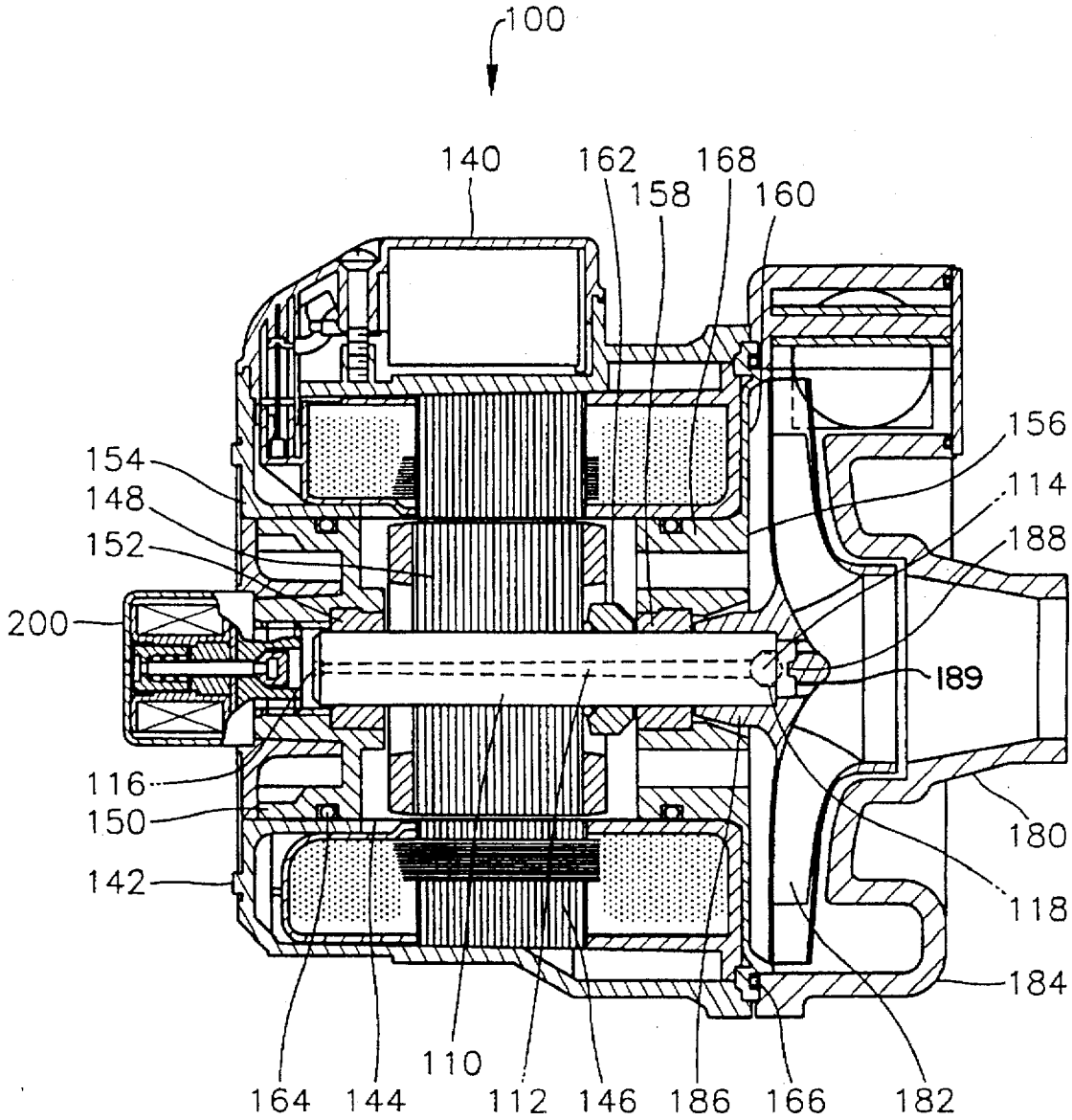
FIG. 2 is a sectional view of an air bubble generating according to an embodiment of the present invention, in which an air supplying device is integrated with a pump.

FIG. 2 is a sectional view of an air bubble generating 100 according to an embodiment of the present invention, in which an air supplying device 110 is integrated with a pump 180. In FIG. 2, air bubble generating apparatus 100 includes a pump 180 for pumping water and for creating a vacuum at a center portion of the pump 180 during pumping of the water, air supplying device 110 for supplying an air to the water by using a difference in air pressure between the center portion of the pump in a vacuum state and an atmosphere. Furthermore, air bubble generating apparatus 100 includes a driving source 140, for example an electric motor, for driving the pump 180.

Air supplying device 110 includes a hollow shaft 112 through which the air flows, a first valve assembly 200 arranged adjacent to a first end of hollow shaft 112, and a second valve assembly 114 arranged at a second end of the hollow shaft 112. Also, hollow shaft 112 of air supplying device 110 includes a rotating shaft of driving source 140. First valve assembly 200 is a solenoid valve and second valve assembly 114 is a ball valve.

Hollow shaft 112 of air supplying device 110 is the rotating shaft of driving source 140. An air inlet port 116 is formed at a first end of hollow shaft 112, an air outlet port 118 is formed at a second end of hollow shaft 112, and a hollow portion of hollow shaft 112 tapers from the first end to the second end. Thus, the air which flows into the tapered hollow portion through inlet port 116 and travels toward outlet 118, has a flow rate that gradually reduces.

A recess for receiving a ball of a valve is formed at air outlet 118 of hollow shaft 112 of air supplying device 110, and a frusto-conical valve seat is formed in the recess connected to the hollow portion of hollow shaft 112. The ball of the ball valve is received in the recess, and makes contact with the valve seat. The diameter of the recess is a little larger than that of the ball of the ball valve, and the depth of the recess including the valve seat is a little smaller than the diameter of the ball of the ball valve.

Figure 3:
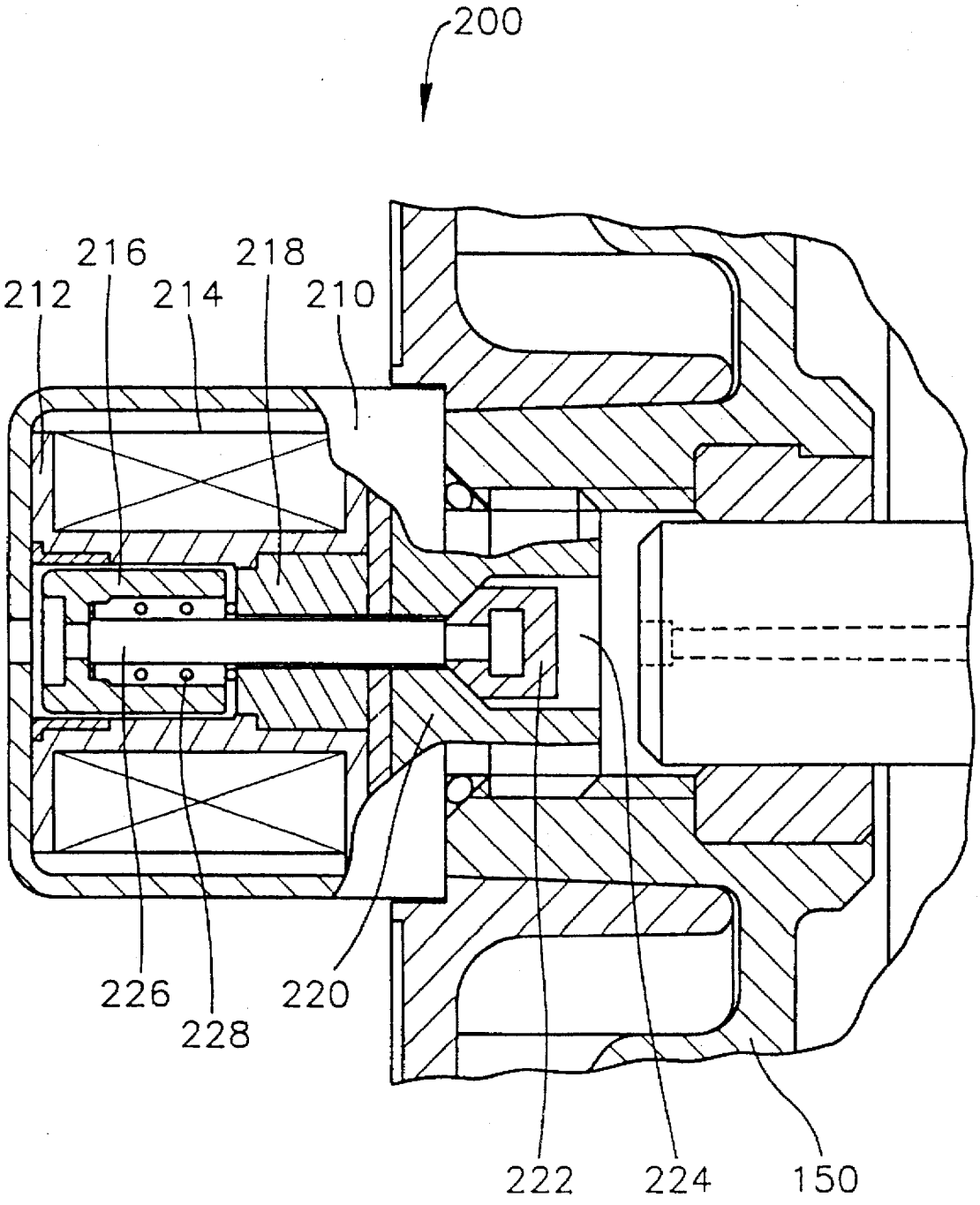
FIG. 3 is a partially enlarged sectional view of the air bubble generating apparatus according to the present invention in FIG. 2, which shows a first valve assembly of an air supplying device in detail.

FIG. 3 is a partially enlarged sectional view of the air bubble generating apparatus 100 according to the present invention in FIG. 2, which shows a first valve assembly 200 of an air supplying device 110 in detail. Referring to FIG. 3, first valve assembly 200 includes a casing 210, through which an air passage is formed at the center portion, a solenoid 214 wound around a bobbin 212 arranged in casing 210, and a cylindrical movable core 216 inserted into bobbin 212 and having a shoulder portion formed radially inward near an edge of movable core 216. Also, a spring supporting member 218 is inserted into bobbin 212 of first valve assembly 200 at a predetermined distance apart from movable core 216. A through hole is formed in spring supporting k member 218.

A connecting member 220 is attached to a surface defined by a side of bobbin 212 and a side of spring supporting member 218, and a through hole having the same diameter as a through hole formed in spring supporting member 218 is formed in a first side of the surface, and a recess 224 receiving a valve body 222 is formed in a second side thereof. A conical valve seat is formed at a portion where recess 224 is connected to the through hole.

A rod 226, which has valve body 222 attached at a first end thereof and which is caught by the shoulder of cylindrical movable core 216 at a second end thereof, extends through cylindrical movable core 216, spring supporting member 218, and connecting member 220. An elastic return spring 228 is disposed in cylindrical movable core 216 between the shoulder of movable core 216 and spring supporting member 218. First valve assembly 200 is screwed to a bearing holder 150.

First valve assembly is periodically operated by an ECU (Electronic Control Unit) (not shown). When a current is provided for solenoid 214, solenoid 214 is magnetized and the current is transmitted to movable core 216 so that valve body 222 opens up. Accordingly, an air passes through the air passage, passes through a gap between bobbin 212 and movable core 216, and through the through holes of spring supporting member 218 and connecting member 220 so that it flows into recess 224.

Referring to FIG. 2 again, driving source 140 includes a cylindrical housing 142, stators 146 arranged on an inner periphery of housing 142 at a predetermined distance apart from each other, and a rotor 148 rotatably inserted in a cylindrical space of housing 142. Bearing holder 150 is inserted into a first opening of a cylindrical space of housing 142 and a second opening of housing 142 is covered with an end cover 156. Bearing 152 is mounted at a first side of bearing holder 150, and first valve assembly 200 is screwed to a second side of bearing holder 150. A groove is formed along a periphery of bearing holder 150. Bearing holder 150 is secured in casing 210 and supports an end of the rotating shaft of rotor 148. End cover 156 comprises a cylindrical bearing holder portion 168 and a flange portion 160. A groove is formed along a periphery of bearing holder portion 168, and an annular ring for sealing air is arranged in the bearing holder portion. Another groove is formed along an edge of flange portion 160 of end cover 156, and an annular ring for sealing air is inserted into the flange portion.

A thrust bearing 162 is mounted on the rotating shaft between end cover 156 and rotor 148. Thrust bearing 162 functions to distribute an axial load that is forced to the rotating shaft.

An annular ring 164 for sealing stators 146 is respectively inserted into the grooves formed in bearing holder 150 and in end cover 156, and respectively seals bearing holder 150 and end cover 156 to housing 142 of driving source 140 and stators 144 so that fluid is prevented from entering the space in housing 142.

Pump 180 is a centrifugal pump and includes an impeller 182 and a pump housing 184. A cylindrical hub 186 is formed at a central portion of a surface of impeller 182 opposite to the outer surface of end cover 156. A projection 188 protrudes upward from the central portion of hub 186. Also, a plurality of through holes 189 connecting the recess of hub 186 with the inner portion of impeller 182, are formed around projection 188. Cylindrical hub 186 of impeller 182 is positioned around the second end of hollow shaft 112 of air supplying device 110.

The ball, which is received in the recess formed at the second end of the rotating shaft, and projection 188, which projects from hub 186, are spaced at a predetermined distance apart from each other. Thus, the valve ball of second valve assembly 114 may travel toward projection 188 to allow the air to flow through the through holes into impeller 182.

Pump housing 184 is such that a water suction port is formed at the central portion thereof and a discharge port is formed at an edge thereof. Pump housing 184 is secured to the edge of flange portion 160 of end cover 156, and sealing ring 166 is disposed between end cover 156 and pump housing 184.

Hereinafter, the operation of each of the elements of the air bubble generating apparatus 100 of the present invention described above will be described.

In air bubble apparatus 100 according to the present invention, when a current is applied to driving source 140, pump 180 connected to the rotating shaft of driving source 140 is operated. As pump 180 is operated, water is sucked through the water suction port in impeller 182 of pump 140. The sucked water is discharged through the discharge port out of impeller 182 by a centrifugal force generated by a rotation force of impeller 182.

At this time, the central portion of impeller 182 becomes a vacuum so that a pressure in impeller 182 is below an atmospheric pressure. In this state, when first valve assembly 200 of air supplying device 110 is operated so that movable core 216 is transferred by electromagnetic force to cause valve body 222 to open, air flows in hollow shaft 112 through first valve assembly 200. Therefore, the difference in a pressure of the hollow portion of hollow shaft 112 and a pressure of the central portion of impeller 182 is generated so that the valve ball of second valve assembly 114 travels toward projection 188 formed in hub 186 of impeller 182. Thus, the air flowing in hollow shaft 112 flows through second valve assembly 114 and the plurality of through holes formed in impeller 182 into impeller 182, and then the air is mixed with a circulating water so as to be discharged out of pump 180.

Air bubble generating apparatus 100 can periodically provide the circulating water with air by repeatedly carrying out the described operation.

On the other hand, when pump 180 stops operating, the water remaining in pump 180 flows backward in hub 186 through the through holes formed in impeller 182. In this case, ball valve 114 disposed at the second end of hollow shaft 112 is closed by a pressure of the water which has flowed backward so as to prevent the water from flowing backward into hollow shaft 112.

As described above, when the air bubble generating apparatus according to the present invention is mounted in and used in the aquarium or the fish bowl at home, the air is periodically mixed with the circulating water so that the amount of the oxygen present in the cistern or the fish basin is constantly maintained.

On the other hand, when the air bubble generating apparatus is mounted in and used in a washing machine, the washing water mixed with the air bubbles is supplied through a fluid passage into the washing tub during a washing so that a washing efficiency of the laundry is enhanced.

Furthermore, the air bubble apparatus according to the present invention is used for providing air to waste water in a waste water treatment system so that organic substrates contained in the waste water is oxidized.

While the present invention has been particularly shown and described with reference to a particular embodiment thereof, it will be understood by those skilled in the art that various changes in form and detail may be effected therein without departing from the spirit and scope of the invention as defined by the appended claims.

What is claimed is:

1. An air bubble generating apparatus comprising:

a pump for pumping water and for creating vacuum at a center portion thereof during pumping of said water;

a driving source for driving said pump and having a bearing holder; and means for supplying air to the water by using an air pressure difference between said center portion of said pump in vacuum and an atmosphere, said air supplying means including a hollow shaft through which the air flows, a first valve assembly adjacent to a first end of the hollow shaft and screwed in said bearing holder, and a second valve assembly arranged at a second end of the hollow shaft.

2. An air bubble generating apparatus as claimed in claim 1, wherein said first valve assembly is a solenoid valve.

3. An air bubble generating apparatus as claimed in claim 1, wherein said second valve assembly is a ball valve.

4. An air bubble generating apparatus as claimed in claim 1, wherein said hollow shaft of said air supplying means includes a rotating shaft of said driving source.

5. An air bubble generating apparatus as claimed in claim 4, wherein a hollow portion of said hollow shaft of said air supplying means tapers from said first end to said second end so that a flow rate of said air reduces when said air flows through said hollow portion.

6. An air bubble generating apparatus as claimed in claim 1, wherein an air inlet port is formed at said first end of said hollow shaft of said air supplying means.

7. An air bubble generating apparatus as claimed in claim 6, wherein an air outlet port is formed at said second end of said hollow shaft of said air supplying means, a recess for receiving a ball for a valve is formed at said air outlet port, and a frusto-conical valve seat is formed in an inner portion of said outlet port.

8. An air bubble generating apparatus as claimed in claim 1, wherein said pump includes an impeller and a housing, a cylindrical hub is formed at an outer center portion of said impeller, a projection is formed at a center portion of said cylindrical hub of said impeller to allow said second valve assembly to travel toward the projection when the air is supplied, said second end of said hollow shaft of said air supplying means is inserted into said cylindrical hub, and a water suction portion is formed at said center portion of said housing.

9. An air bubble generating apparatus as claimed in claim 8, wherein a plurality of through holes are formed around said projection of said center portion of said impeller.

10. An air bubble generating apparatus as claimed in claim 9, wherein when vacuum is generated in said impeller by a rotation of said impeller during an operation of said pump so that there is a difference in pressure between said hollow portion, and an inner portion of said impeller, a valve ball of said second valve assembly arranged between said second end of said hollow shaft and said annular projection of said center portion of said impeller moves to said projection so that said air flows through said through holes into said impeller.

11. An air bubble generating apparatus as claimed in claim 1, wherein said driving source includes a cylindrical housing, stators arranged on an inner periphery of said housing at a predetermined distance apart from each other, and a rotor rotatably inserted into a cylindrical space of said housing, wherein said bearing holder is inserted into a first opening of said cylindrical space of said housing and a second opening thereof is covered with an end cover.

12. An air bubble generating apparatus as claimed in claim 11, wherein said end cover comprises a cylindrical bearing holder portion and a flange portion, a first groove is formed along a periphery of said cylindrical bearing holder portion, a first annular ring for sealing air is arranged in said cylindrical bearing holder portion, a second groove is formed along an edge of said flange portion of said end cover, a second annular ring for sealing air is inserted into said flange portion, and said housing of said pump is coupled to said edge of said flange portion of said end cover.

13. An air bubble generating apparatus as claimed in claim 12, wherein a screw is formed in an inner peripheral surface of said bearing holder, a bearing is arranged at a portion opposite to a side portion of said driving source, and said first valve assembly is screwed to said screw of said inner peripheral surface.

14. An air bubble generating apparatus comprising:

a pump for pumping water and for creating vacuum at a center portion thereof during pumping of said water, said pump including an impeller and a housing, a cylindrical hub formed at an outer center portion of said impeller, an annular projection formed at a center portion of said cylindrical hub of said impeller, and a water inlet port formed at a center portion of said housing;

a driving source for driving said pump, said driving source including a cylindrical housing, stators arranged on an inner periphery of said housing at a predetermined distance apart from each other, and a rotor rotatably inserted into a cylindrical space of said housing, a bearing holder inserted into a first opening of said cylindrical space and an end cover covering a second opening thereof; and means for supplying air for the water by using an air pressure difference between said center portion in vacuum and an atmosphere, said air supplying means including a hollow shaft in which said air flows, a first valve assembly adjacent to a first end of the hollow shaft and screwed in the bearing holder of the driving source, and a second valve assembly arranged at a second end of the hollow shaft.

15. An air bubble generating apparatus as claimed in claim 14, wherein said first valve assembly is a solenoid valve.

16. An air bubble generating apparatus as claimed in claim 14, wherein said second valve assembly is a ball valve.

17. An air bubble generating apparatus as claimed in claim 14, wherein a hollow portion of said hollow shaft of said air supplying means tapers from said first end to said second end so that a flow rate of said air reduces when said air flows through said hollow portion.

18. An air bubble generating apparatus as claimed in claim 17, wherein said hollow shaft of said air supplying means includes a rotating shaft of said driving source.

19. An air bubble generating apparatus as claimed in claim 18, wherein an air inlet port is formed at said first end of said hollow shaft of said air supplying means.

20. An air bubble generating apparatus as claimed in claim 19, wherein an air outlet port is formed at said second end of said hollow shaft of said air supplying means, a recess for receiving a ball of a ball valve is formed at said air outlet port, and a frusto-conical valve seat is formed in an inner portion of said ball of the ball valve.

21. An air bubble generating apparatus as claimed in claim 14, wherein a plurality of through holes are formed around said annular projection of said center portion of said impeller.

22. An air bubble generating apparatus as claimed in claim 21, wherein when a vacuum pressure is generated in said impeller by a rotation of said impeller during an operation of said pump so that there is a difference in a pressure between said hollow portion and an inner portion of said impeller, a valve ball of said second valve assembly arranged between said second end of said hollow shaft and said annular projection of said center portion of said impeller is moved to said projection so that said air flows through said through holes into said impeller.

23. An air bubble generating apparatus as claimed in claim 22, wherein said driving source includes a cylindrical housing, stators arranged on an inner periphery of said housing at a predetermined distance apart from each other, and a rotor rotatably inserted in a cylindrical space of said housing, wherein said bearing holder is inserted into a first opening of said cylindrical space of said housing and a second opening of said cylindrical space of said housing is covered with an end cover.

24. An air bubble generating apparatus as claimed in claim 23, wherein said end cover is formed of a cylindrical bearing holder portion and a flange portion, a first groove is formed along a periphery of said cylindrical bearing holder portion, a first annular ring for sealing air is arranged in said cylindrical bearing holder portion, a second groove is formed along an edge of said flange portion of said end cover, a second annular ring for sealing air is inserted in said cylindrical bearing holder portion, and said housing of the pump is coupled to said edge of said flange portion of said end cover.

25. An air bubble generating apparatus as claimed in claim 24, wherein a screw is formed on an inner peripheral surface of said bearing holder, a bearing is arranged at a portion opposite to a side portion of said driving source, and said first valve assembly is screwed to said screw of said inner peripheral surface.

26. An air bubble generating apparatus comprising:

a pump for pumping water and for creating vacuum at a center portion thereof during pumping of said water, said pump including an impeller and a housing, a cylindrical hub formed at an outer center portion of said impeller, an annular projection formed at a center portion of said cylindrical hub of said impeller, a plurality of through holes formed around said annular projection of said center portion of said impeller, and a water inlet port formed at a center portion of said housing;

a driving source for driving said pump, said driving source including a cylindrical housing, stators arranged on an inner periphery of said housing at a predetermined distance apart from each other, and a rotor rotatably inserted in a cylindrical space of said housing, a bearing holder inserted into a first opening of said cylindrical space of said housing and an end cover covering a second opening of said cylindrical space of said housing; and means for supplying air for the water by using an air pressure difference between said center portion in vacuum and an atmosphere, said air supplying means including a hollow shaft having an air inlet port formed at a first end thereof, an air outlet port formed at a second end thereof, and a recess for receiving a ball of a ball valve and having frusto-conical valve seat formed in an inner portion thereof formed at said outlet port so that air flows through said hollow shaft, a solenoid valve adjacent to said first end of said hollow shaft and screwed in the bearing holder of said driving source, and a ball valve arranged at said second end of said hollow shaft.

27. An air bubble generating apparatus as claimed in claim 26, wherein a hollow portion of said hollow shaft of said air supplying means tapers from said first end to said second end so that a flow rate of said air reduces when said air flows through said hollow portion.

* * * * *